United States Patent [19]

Koch et al.

[11] Patent Number: 5,021,174

[45] Date of Patent: Jun. 4, 1991

[54] COMPOUNDS USEFUL AS DETERGENT ADDITIVES FOR LUBRICANTS AND LUBRICATING COMPOSITIONS

[75] Inventors: Paolo Koch, Melegnano; Alfonso Di Serio, Rome, both of Italy

[73] Assignees: Euron S.p.A., Milan; Agip Petroli S.p.A., Rome, both of Italy

[21] Appl. No.: 478,705

[22] Filed: Feb. 8, 1990

Related U.S. Application Data

[63] Continuation of Ser. No. 372,134, Jun. 26, 1989, abandoned, which is a continuation of Ser. No. 49,396, May 14, 1987, abandoned.

[30] Foreign Application Priority Data

May 27, 1986 [IT] Italy ..... 20572 A/86

[51] Int. Cl.[5] ..... C10M 125/10; C10M 129/28

[52] U.S. Cl. ..... 252/38; 252/39; 252/56 D

[58] Field of Search ..... 252/56 D, 38, 39

[56] References Cited

U.S. PATENT DOCUMENTS 2,292,308 8/1942 Watkins ..... 252/56 D 2,349,817 5/1944 Farrington et al. ..... 252/39

2,682,489 6/1954 Von Fuchs ..... 252/56 D 2,715,108 8/1955 Frances ..... 252/56 D 2,775,560 12/1956 Lurton et al. ..... 252/56 D

*Primary Examiner*—Jacqueline V. Howard

*Attorney, Agent, or Firm*—Birch, Stewart, Kolasch & Birch

[57] ABSTRACT

The alkali-metal and alkaline-earth-metal salts are disclosed of a monoester of a bicarboxy acid having the formula:

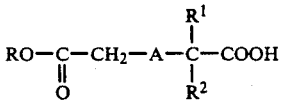

wherein R is alkyl, $R^1$ is either hydrogen or alkyl, $R^2$ is alkyl and A is nothing or alkylene, and the corresponding hyperbasic derivatives, useful as detergent additives for lubricants.

Also the lubricating compositions containing such additives are disclosed.

13 Claims, No Drawings

COMPOUNDS USEFUL AS DETERGENT ADDITIVES FOR LUBRICANTS AND LUBRICATING COMPOSITIONS

This application is a continuation of Ser. No. 07/372,134 filed on June 26, 1989, now abandoned, which was a continuation of application Ser. No. 07/049,396, filed May 14, 1987, now abandoned.

The present invention relates to new compounds useful as detergent additives for lubricants, and to the lubricating compositions containing the new additives.

More particularly, a first object of the present invention is an alkali or alkaline earth metal salt of a monoester of a bicarboxy acid having the formula:

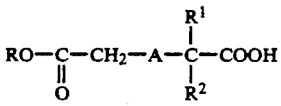

(I)

wherein R is alkyl, $R^1$ is either hydrogen or alkyl, $R^2$ is alkyl and A is nothing or alkylene, with the proviso that:

a) the sum of carbon atoms contained in R, A, $R^1$ and $R^2$ radicals is equal to, or higher than 15; and b) when A is nothing, the sum of carbon atoms contained in $R^1$ and $R^2$ is lower than 50;

To the purposes of the present invention, in the definition of R, $R^1$, $R^2$ and A radicals in formula (I), the terms "alkyl" and "alkylene" mean a monovalent alkyl and, respectively, bivalent radical, having a linear or branched chain, containing a whatever number of carbon atoms, and generally containing from 1 to 30 carbon atoms.

The alkali or alkaline earth metal salts of the compounds of are useful as detergent additives for lubricants.

The "detergent" lubricants are so denominated, in as much as they perform the general function of keeping an engine clean.

They prevent in fact, or considerably delay, the formation of foulings and coal inside, the engine, and, in particular, on the pistons and on the cylinder walls thereof, and constitute hence an extremely important class of additives for lubricating oils.

Commonly used detergent additives for lubricating oils are the alkali-metal or alkali-earth-metal salts of organic acids, chemically similar to the common soaps used in the field of detergency in aqueous phases. But, as the use of these additive in lubricant bases requires them to be perfectly soluble in these bases, the selection of the organic acid to be used in the form of its metal-salt derivative is extremely important and critical.

Commonly, the alkali-metal or alkali-earth-metals salts used are of such compounds as (either vegetable or animal) natural fatty acids, higher synthetic fatty acids, sulphonic acids, phenols, sulphophenols, and so forth. As additives for lubricants, the metal salts of monoesters of succinic acid substituted with hydrocarbon chains containing at least 50 carbon atoms (cfr. U.S. Pat. No. 3,632,510) are also known.

The compounds of the present invention are expediently prepared by starting from the corresponding bicarboxy-acids by esterification with an alcohol

R—OH wherein the presence of substituents on one of the two carbon atoms in the α-position relatively to the carboxy groups allows the semiester to be selectively formed on the carboxy group, the carbon atoms in the α-position to which is not substituted.

The reaction is easily carried out by heating to above 100° C. a mixture containing about equimolar amounts the bicarboxy acid and the alcohol, and distilling off the water which is formed during the condensation.

Operating at temperatures comprised within the range of from 150° C. to 300° C. in the absence of solvent is generally preferred, but it can be sometimes expedient to perform the reaction in the presence of an inert, high-boiling solvent, which may facilitate the blending. In such a case, suitable solvents can be, for example, xylene, toluene, chlorobenzene, diphenylether or mineral oils. The reaction is complete within some hours, yielding the desired semiester (I), which can be fed as such to the salification step. It may be sometimes expedient to carry out the reaction in the presence of a suitable esterification catalyst, such as, e.g., sulphuric acid, p-toluenesulphonic acid, hydrochloric acid, phosphoric acid, or other similar catalysts.

If used, such a catalyst shall be used in amounts comprised within the range of from 0.01% to 5%, or, more preferably, of from 0.1% to 2.5% by weight. When A is nothing, as an alternative to this general method for the synthesis of the semiesters, the reaction can be carried out by using, in lieu of the derivative of succinic acid, the corresponding derivative of succinic anhydride, which has the equivalent behaviour. In such a case, obviously, no water will be formed, but the reaction shall proceed in an analogous way, always selectively leading to the semiester, wherein the esterified carboxy group is the one, the carbon atom in the α-position relatively to which is unsubstituted.

From an industrial standpoint it may be sometimes expedient to use starting products which are not individual products, but consist actually of blends of isomer or of analogous compounds, thus blends of esters of formula (I) are obtained, the chemical composition of which, and the relative proportion of the individual components of which are not easily determined. Such mixtures, which can be used as well, in the form of their corresponding metal salts, as the detergent additives, are obviously within the scope of the present invention.

The so-obtained ester-acids are then converted into their corresponding alkali-metal or alkali-earth-metal salts by being reacted with a suitable base.

The reaction is expediently carried out at a temperature comprised within the range of from room temperature to 250° C., and, preferably, of from 80° C. to 200° C. by using an alkali-metal or alkali-earth-metal base and an inert organic diluent. Toluene, xylene, heptane, cyclohexane, mineral oils, etc., can be well used to this purpose. The base will be generally used in a stoichiometrically equivalent amount.

Alkali-metal or alkali-earth-metal bases which can be expediently used comprise the hydroxides, carbonates, bicarbonates, alkoxides and phenates of metals of the I and II Groups, and, in particular, of sodium, potassium, lithium, magnesium, calcium and barium. The procedures for salifying carboxy acids are well-known in organic chemistry, and they therefore do not require to be described in greater detail.

The salified semiesters of formula (I), as well as their blends, can be efficaciously used as such as detergent additives for several types of lubricating compositions containing one or more lubricating oils of synthetic, mineral, vegetable or animal origin. The concentration of such additives in the lubricants is normally comprised within the range of from 0.01% to 20% by weight, and preferably of from 0.5 to 10% by weight, according to the lubricant bases used and of the required performance, although, when a particular performance, or use on particular engine types, is required, even higher amounts may be used.

A second object of the present invention are hence the lubricating compositions containing one or more lubricating oils of synthetic, mineral, vegetable or animal origin, and the alkali-metal or alkali-earth-metal salt of at least one compound of formula (I). Such lubricating compositions can obviously contain other additives, such as, e.g., antioxidants, dispersants, viscosity index improvers, fluidifiers, antiwear agents, and so on, besides other supplementary detergent additives.

Suitable bases for such lubricant compositions are, e.g., the natural oils from either vegetable or animal sources, as well as those of mineral origin, of either paraffinic or naphthenic type, but, in particular, the oils of synthetic origin commonly presently used in engine applications.

The salt derivatives of the compounds of formula (I) besides being suitable to be used as such, can be also used to the purpose of producing a further class of additives, the so-called "hyperbasic" additives. The salt derivatives of the present invention are well suitable in fact for forming a stable colloidal suspension of alkali-metal or alkali-earth-metal carbonate in oil. This gives the possibility of formulating the additive as a suspension approximately containing about 30% of alkali-metal or alkali-earth-metal carbonate, 30% of alkali-metal or alkali-earth-metal salt of one or more of the compounds of formula (I), and 40% of mineral oil. Such a formulation of the additive is stable, fluid, so as to allow conveyance movements to be easily applied, as well as so that it can be easily formulated into the end lubricant, and is perfectly soluble in all proportions in mineral and synthetic lubricant bases.

The presence of a high amount of inorganic carbonate in the additive allows lubricants to be formulated, which contain it in concentrations of from 2% to 20%, which, besides the true detergent activity, are endowed with high neutralizing properties towards possible acidic agents they may come in contact with.

This neutralizing capability is essential when during its use the lubricant is required to supply, besides a specific protection of mechanical components against wear, good protection from corrosion. This is, e.g., the case of the neutralization of sulphuric and nitric acids present in the flue gases emitted by the internal combustion engines, and of the protection from corrosive actions by water and moisture-containing corrosive agents (sea water, acidic solutions). In this field the hyperbasic derivatives are well-known of sulphonic acids and of sulphophenols, in as much as from these substrates forming stable colloidal suspensions of inorganic carbonate is possible; obtaining analogous products from organic carboxy acids is a more critical step. In this case, the structure and molecular complexity of the acid has in fact a conclusive influence on the characteristics of the additive.

Fatty acids from natural sources, e.g., are not suitable for obtaining hyperbasic derivatives; in fact, from these unstable colloidal suspensions, with a high trend to gelling, are obtained.

As already said, the compounde of the present invention, are, on the contrary, well fit to the formation of their corresponding hyperbasic derivatives, which yield very stable colloidal suspensions of inorganic carbonate, which are soluble in all proportions in the bases of either mineral or the synthetic type, and which give to the lubricants which contain them a performance at least equivalent, but often better than obtained with a conventional addition of commercial hyperbasic products.

The new hyperbasic derivatives of the present invention can be prepared by any of the methods known from the technical literature for the preparation of the hyperbasic sulphonates (see, e.g., U.S. Pat. Nos. 2,467,176; 2,616,905; 3,057,896; 3,321,399; 3,429,811; 3,629,109; 3,671,430; 3,928,216; 4,086,170; 4,192,758; and EP-A-7257 and EP-A-7260).

A method which can be advantageously used for performing the process of rendering hyperbasic the compounds of the invention consists in forming a suspension of alkali-metal or alkali-earth-metal hydroxide in the detergent additive in the presence of alcohol and of a hydrocarbon solvent, then adding some $CO_2$, so to transform the oxide or hydroxide into its corresponding carbonate, removing the alcohol and the hydrocarbon solvent, while adding at the same time a certain amount of a lubricating oil which is compatible with the lubricating composition into which the additive is to be incorporated, so to directly obtain the stable colloidal suspension of the inorganic carbonate in the additive.

A third object of the present invention is hence a concentrated, stable additive, containing a high level of alkali-metals or alkali-earth-metals, consisting in a colloidal dispersion of an alkali-metal or alkali-earth-metal carbonate in mixture with the alkali-metal or alkali-earth-metal salt of at least one compound of formula (I), in oil.

According to a preferred form of practical embodiment of the invention, the alkali-metal or alkali-earth-metal carbonate is calcium carbonate, and the oil is mineral oil, due to an easier compatibility with the normal marketed lubricating oils.

On the contrary, as relates to the alkali-metal or alkali-earth-metal salt of the compound of formula (I), according to a preferred form of practical embodiment of the invention, this is selected from a group consisting of lithium, sodium, potassium, calcium, magnesium or barium salt of a compound of formula (I), wherein R is an alkyl of from 10 to 20 carbon atoms, A is nothing or an alkylene containing from 1 to 10 carbon atoms, $R^1$ is either hydrogen or an alkyl containing from 1 to 15 carbon atoms, and $R^2$ is an alkyl of from 1 to 15 carbon atoms.

In fact, the compounds belonging to this group, besides offering an optimum performance, as to their activity as detergents, as well as to their optimum suitability to be formulated as hyperbasic concentrates, allow also their production to start from low-cost raw materials, to be easily found on the market.

By looking more deeply into this latter aspect, the most preferred compounds of formula (I), for the time being, will be synthetized by starting from such bicarboxy acids as, e.g., 2,2,4-trimethyl-adipic acid, 2,4,4-trimethyl-adipic acid, dodecyl-succinic acid, 1,8-heptane-dicarboxy acid, 1,9-heptane-dicarboxy acid, and so forth, and alcohols R—OH of synthetic origin, wherein R contains from 12 to 20 carbon atoms, and, in particular, the $C_{12}$–$C_{14}$ or $C_{16}$–$C_{18}$ fractions, easily obtained on an industrial scale, by means of the hydroformylation (oxo-synthesis) process.

The following examples disclose in detail the preparation of some compounds of formula (I), representative of the invention, as well as of their corresponding hyperbasic derivatives, together with the characteristics of the so-obtained products.

EXAMPLE 1

Semiester of trimethyladipic acid 188.2 g (1 mol) of trimethyladipic acid, consisting of the 40:60 blend of the two 2,2,4-trimethyl-:2,4,4-trimethyl-isomers is charged to a spherical reactor equipped with stirrer, thermometer, vapour condenser, together with 220 g (1 mol) of primary $C_{14}$–$C_{15}$-oxo-alcohols, consisting of a blend of derivatives having linear and branched alkyl chain.

The reaction mixture is slowly heated to 180° C. and is kept at that temperature for 6 hours, with water eliminated during the reaction being condensed. The temperature is then increased up to 230° C., with a slow stream of nitrogen being fed for the reactor, to the purpose of facilitating water removal. After 2 hours at such a temperature, the release of water ends completely. The semiester derivative of trimethyladipic acid is cooled under nitrogen.

The product has a viscosity of 8.8 cSt at 100° C. and of 73.2 cSt at 40° C.; its neutralization number is 162 mg of KOH/g; it shows the typical I.R. absorption bands at 1,740 $cm^{-1}$ attributed to the ester function, and at 1,700 $cm^{-1}$, attributed to the carboxy function.

EXAMPLE 2

Semiesters of heptadecanedicarboxy acid 328 g (1 mol) of heptadecanedicarboxy acid, consisting of the equimolar blend of the two 1,8- and 1,9-dicarboxy-isomers, is charged to a spherical reactor equipped with stirrer, thermometer, and vapour condenser, together with 210 g (1 mol) of primary $C_{12}$–$C_{15}$-oxo-alcohols, consisting of a blend of derivatives having linear and branched alkyl chain.

The reaction mixture is slowly heated to 180° C. and is kept at that temperature for 6 hours, with water formed during the reaction being eliminated. The temperature is then increased up to 230° C., with a slow stream of nitrogen being fed to the reactor, to the purpose of facilitating water removal. After 2 hours at such a temperature, the release of water ends completely. The semiester derivative of heptanedicarboxy acid is cooled under a nitrogen atmosphere.

The product has the viscosity of 13.5 cSt at 100° C. and of 102.3 cSt at 40° C. It shows the typical I.R. absorption bands at 1,740 $cm^{-1}$ and at 1,700 $cm^{-1}$ of the ester and carboxy groups, and its neutralization number is 120 mg of KOH/g.

EXAMPLE 3

Semiesters of heptadecanedicarboxy acid

The reaction is carried out as disclosed in Example 2, but with a primary $C_{14}$–$C_{15}$ oxo-alcohol constituted by only branched isomers being used.

A product with a viscosity at 100° C. of 13.6 cSt, and at 40° C. of 102.6 cSt, and having a neutralization number of 110 mg of KOH/g is obtained.

EXAMPLE 4

Semiesters of dodecenylsuccinic acid 266 g (1 mol) of dodecenylsuccinic anhydride is reacted with 220 g (1 mol) of primary $C_{14}$–$C_{15}$-oxo-alcohols, constituted by branched isomers, in a flask equipped with stirrer, thermometer, and condenser.

The reaction mixture is slowly heated to 150° C. for three hours. In this case, no water is formed. After 3 hours, the reaction mass is cooled and the product is discharged. The product has a viscosity at 100° C. of 10.8 cSt; a saponification number of 200 mg of KOH/g, and a neutralization number of 100 mg of KOH/g.

EXAMPLE 5

Hyperbasic derivative from trimethyladipic acid (TMA)

To a cylindrical reactor, provided with a jacket for temperature-control fluid circulation, equipped with stirrer, thermometer, condenser, load funnel for liquids, and dipleg for gas loading, 300 g is charged with TMA semiester as prepared in Example 1, together with 470 g of toluene, 196 g of methanol, and 143 g of $Ca(OH)_2$ is then added over a 15-minute time, with the mixture being kept stirred. Through the gas-loading dipleg, into the mixture 57 g is delivered of carbon dioxide, with the gas flowrate being so adjusted, that it is completely absorbed. The $CO_2$-addition step lasts 2 hours and the temperature increases gradually up to 50° C. After the $CO_2$ flow is discontinued, the reaction mass is slowly heated to 65° C. to the purpose of distilling off methanol.

During this distillation, through the load funnel 357 g of paraffinic mineral oil SN 150 is added. The temperature of the reaction mass is then increased to 98° C. to the purpose of distilling off $H_2O$/toluene azeotrope, and finally to 140° C., to distill off all of toluene still present inside the reaction mixture.

The so-obtained product is treated with 40° C. of a filtration coadjuvant, and is filtered over a 200-mesh wire net under a pressure of 2 abs.atm. The end product obtained has a viscosity of 33.5 cSt at 100° C., a TBN of 254 mg of KOH/g, anf contains 8.9% of Ca.

The product is soluble in mineral oil in all proportions, and solutions are obtained which are perfectly clear, and free from precipitates or suspended solid matter.

EXAMPLE 6

Hyperbasic derivative from heptanedicarboxy acid semiesters 250 g of heptanedicarboxy-acid semiester as prepared in Example 2 is charged to react to a reactor, provided with a jacket, equipped with stirrer, thermometer, condenser, load funnel for liquids, together with 300 g of toluene and 254 g of methanol. Within a 30-minute time, 180 g of $Ca(OH)_2$ is then added.

Then, through the gas-loading dipleg, a stream is delivered of $CO_2$, at such a flowrate, that it is completely absorbed. Over three hours, 80 g of $CO_2$ is supplied, and the temperature increases gradually up to 50° C.

After the gas flow is discontinued, the reaction mass is slowly heated to 65° C. and methanol is distilled off, while through the load funnel 250 g of paraffinic mineral oil SN 150 is added. The temperature of the reactor is then increased to 98° C. to the purpose of distilling off $H_2O$/toluene azeotrope, and finally to 140° C., to distill off all of still present toluene.

The reaction product is filtered, with the addition of a filtration coadjuvant, over a 200-mesh wire net under a pressure of 2 abs.atm.

The end product has a viscosity of 27.2 cSt at 100° C., a TBN of 315, a Ca content of 11.2%, and is perfectly soluble in all proportions in mineral and synthetic (poly-alpha-olefins, esters) lubricant bases.

EXAMPLE 7

The heptanedicarboxy-acid semiester of Example 3 is treated exactly as disclosed in Example 6, to yield a hyperbasic product endowed with the following characteristics:

viscosity at 100° C.: 25.1 cSt; TBN: 320; Ca: 11.5%

EXAMPLE 8

Hyperbasic derivative from dodecenylsuccinic acid semiester 205 g of semiester of dodecenylsuccinic acid as prepared in Example 4 is treated inside reactor, provided with a jacket, stirrer, thermometer, condenser, dipleg for gas loading and load funnel, with 330 g of toluene and 137 g of methanol. Within a 30-minute time, 100 g of $Ca(OH)_2$ is then added.

A stream is then delivered of $CO_2$, at such a flowrate, that it is completely absorbed by the reaction mixture.

Over two hours, 40 g of $CO_2$ is metered into the reaction mass, and the temperature increases gradually up to 50° C.

The reaction mass is heated to 65° C. and methanol is distilled off, while 250 g of paraffinic mineral oil SN 150 is added. The temperature is then increased to 98° C. to the purpose of distilling off $H_2O$/toluene azeotrope, and finally to 140° C., to distill off all the solvent.

The reaction product is filtered, with the addition of a filtration coadjuvant, over a 200-mesh wire net under a pressure of 2 abs.atm.

The product has a viscosity of 19.1 cSt at 100° C., a TBN of 246 mg of KOH/g, and a Ca content of 8.7%.

It is perfectly soluble in all proportions in mineral and synthetic (poly-alpha-olefins, esters) lubricant bases.

EVALUATION OF ANTI-RUST POWER

The product of Example 5 was evaluated in a formulation containing 20% by weight thereof in a paraffinic mineral basis (solvent Neutral SN80), for its protective properties for iron-based materials.

The evaluation was carried out according to DIN-50017 procedure, as required for testing materials, structural components and equipment by the test methodology for saturated damp atmospheres.

By such a method, the metal specimens must be treated with the lubricant which contains the additive, and are then kept under a water-saturated atmosphere at 40° C. for repeated 24-hour cycles, during which, by temperature being decreased, water is condensed on the same specimen.

The test is regarded as passed if the specimen shows rust stains, after 20 cycles, on not more than 5% of its surface.

The above formulation allows a completely rust-free specimen to be obtained after 20 cycles of 24 hours.

A specimen of the same material, treated with an oil-based solution at 20% by weight of a commercial hyperbasic calcium sulphate (TBN 300 mg KOH/g; Ca=about 12%) in SN 80, after 20 24-hour cycles has more than 5% of its surface coated with rust.

We claim:

1. A concentrated additive, having a high content of alkali or alkaline earth metals, consisting of a colloidal dispersion of an alkali-metal or alkaline earth metal carbonate, in admixture with at least one alkali metal or alkaline earth metal salt of a compound having the formula:

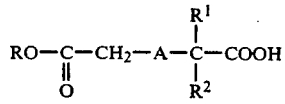

wherein R is alkyl, $R^1$ is ether hydrogen or alkyl, $R^2$ is alkyl and A is a single bond or alkylene with the proviso that:

a) the sum of carbon atoms contained in R, A, $R^1$ and $R^2$ is equal to, or greater than 15; and b) when A is a single bond, the sum of carbon atoms contained in $R^1$ and $R^2$ is less than 15; and an oil.

2. The concentrated additive according to claim 1, wherein said alkali-metal or alkali-earth-metal carbonate is calcium carbonate.

3. The concentrated additive according to claim 2, wherein said oil is a mineral or synthetic oil.

4. The concentrated additive according to claim 3, comprising about 30% of calcium carbonate, about 30% of at least one of said alkali-metal or alkali-earth-metal salts of the compound of formula 1; and about 40% of mineral oil.

5. The lubricating composition comprising a major amount of one or more lubricating oils, and a minor amount of a concentrated additive according to any one of claims 1 to 4.

6. The lubricating composition according to claim 5, wherein said concentrated additive is within the range of from 2 to 20%.

7. A method of preventing or delaying the formation of foulings and coal inside an engine which comprises using in said engine a lubricating composition containing:

a major proportion of one or more lubricating oils; and a minor proportion of a concentrated additive with a high content of alkali-metals or alkali-earth-metals, consisting of a colloidal dispersion in oil of an alkali-metal or alkali-earth-metal carbonate in mixture with at least one alkali-metal or alkali-earth-metal salt of a compound having the formula (1):

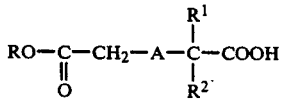

(1)

wherein R is alkyl, $R^1$ is either hydrogen or alkyl, $R^2$ is alkyl and A is a single bond or alkylene, with the proviso that:

a) the sum of carbon atoms contained in said R, A, $R^1$ and $R^2$ radicals is equal to, or greater than 15; and b) when A is a single bond, the sum of carbon atoms contained in $R^1$ and $R^2$ is lower than 50.

8. The method according to claim 7, wherein said alkyl group contains from 1 to 30 carbon atoms and said alkylene group contains from 1 to 30 carbon atoms.

9. The method according to claim 7, wherein R is an alkyl which contains from 10 to 20 carbon atoms, A is a single bond or an alkylene of from 1 to 10 carbon atoms, $R^1$ is hydrogen or an alkyl which contains from 1 to 15 carbon atoms, and $R^2$ is an alkyl which contains from 1 to 15 carbon atoms.

10. The method according to claim 7, wherein said alkali-metal or said alkali-earth-metal carbonate is calcium carbonate.

11. The method according to claim 7, wherein said oil is a mineral oil or a synthetic oil.

12. The method according to claim 7, wherein said concentrate additive contains about b 30% of calcium carbonate, about 40% of mineral oil, and about 30% of at least one alkali-metal or alkali-earth-metal salt of a compound having formula (1):

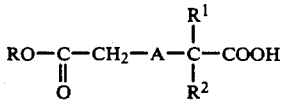

(1)

wherein R is alkyl, $R^1$ is either hydrogen or alkyl, $R^2$ is alkyl and A is a single bond or alkylene, with the proviso that:

a) the sum of carbon atoms contained in said R, A, $R^1$ and $R^2$ radicals is equal to, or greater than 15; and b) when A is a single bond, the sum of carbon atoms contained in $R^1$ and $R^2$ is lower than 50.

13. The method according to claim 7, wherein said concentrated additive is present within the range of from about 2 to 20%.

* * * * *